United States Patent [19]

Parsons

[11] Patent Number: 5,065,033

[45] Date of Patent: Nov. 12, 1991

[54] CONNECTOR LOCK ASSEMBLY

[75] Inventor: George W. Parsons, North Reading, Mass.

[73] Assignee: Amersham Corporation, Burlington, Mass.

[21] Appl. No.: 543,328

[22] Filed: Jun. 25, 1990

[51] Int. Cl.[5] ..... G21F 5/02

[52] U.S. Cl. ..... 250/497.1; 378/119; 378/203

[58] Field of Search ..... 250/497.1; 378/119, 378/203

[56] References Cited

U.S. PATENT DOCUMENTS

| | | | |
|---|---|---|---|
| 3,939,355 | 2/1976 | Rosauer | 250/497.1 |
| 4,211,928 | 7/1980 | Parsons, Jr. et al. | 250/497 |
| 4,225,790 | 9/1980 | Parsons, Jr. et al. | 250/497 |
| 4,281,252 | 7/1981 | Parsons, Jr. et al. | 250/497 |
| 4,827,493 | 5/1989 | Parsons et al. | 378/119 |

*Primary Examiner*—Jack I. Berman

*Attorney, Agent, or Firm*—Wolf, Greenfield & Sacks

[57] ABSTRACT

A coupling apparatus for connecting a separable control cable assembly to a camera storage unit in a radiographic system, having a connector assembly fixed to the camera storage unit and a separable control cable assembly. The separable control cable assembly is attached the camera storage unit via the fixed connector assembly for controlling movement of radioactive material attached to a source cable to a desired location outside of the camera storage unit. The camera storage unit stores the source cable and attached radioactive material in an aperture where the two are locked against removal. Proper connection of the separable control cable assembly to the camera storage unit releases the source cable and radioactive material from their lock position. Upon releasing the source cable and radioactive material from their lock position, the control cable assembly is prevented from being removed from ther camera storage unit. The control cable assembly, with a control cable, guides the source cable and radioactive material to a desired location and returns the soure cable and radioactive material to their storage position within the camera storage unit, at which time the two are automatically locked in position and releasing of the control cable assembly is enabled.

19 Claims, 7 Drawing Sheets

CONNECTOR LOCK ASSEMBLY

BACKGROUND OF THE INVENTION

1. Field of the Invention

The present invention relates in general to a coupling apparatus for connecting a separable control cable assembly to a camera storage unit in a radiographic system for controlling movement of a radioactive material, stored in the camera storage unit, between the stored location and a use location outside of the camera storage unit. More particularly, the invention relates to a coupling apparatus wherein a connector assembly is fixed to a camera storage unit and is adapted to receive and lock against removal a control cable assembly for controlling movement of the radioactive material to a use location outside of the camera storage unit and wherein safe storage of the radioactive material is ensured upon returning the radioactive material to its stored location within the camera storage unit.

2. Description of the Prior Art

There are many different types of coupling apparatuses for connecting cable controls to storage units for radioactive material, in order to safely provide for controlling the movement of the radioactive material. Typical patents that cover coupling apparatuses include U.S. Pat. No. 4,211,928, and U.S. Pat. No. 4,281,252, both by Parsons, the applicant herein.

U.S. Pat. No. 4,211,928 discloses a coupling apparatus which provides for automatic locking of the radioactive material within the storage unit when the control cable guides the radioactive material back to its stored position. The radioactive material is enclosed within a capsule, attached to a flexible source cable which is accessed by the control cable for guidance through and out of the camera storage unit. The automatic locking of the radioactive material within the camera storage unit is accomplished by adding a fitting to the radioactive capsule which releases a shutter to automatically lock the radioactive material in the stored position. This requires the addition of the fitting material to the front of the radioactive capsule, a burdensome arrangement, which must move with the radioactive capsule at all times.

The aforementioned U.S. Pat. No. 4,281,252 is typical of more recent coupling apparatuses which include the following fail safe features: (1) that the radioactive capsule remains in the storage unit until a proper connection has been made by the control cable assembly; (2) that the control cable assembly cannot be attached to the storage unit until the source cable assembly has been properly accessed by the control cable; (3) that the radioactive capsule must be safely stored in the storage unit before the control cable assembly can be disconnected. This arrangement does not, however, provide for the automatic locking of the radioactive capsule within the storage unit, upon its return to its stored position within the storage unit.

Accordingly, it is an object of the present invention to provide for a coupling apparatus which provides the safety features of retaining the radioactive capsule within the storage unit until a proper connection has been made by the control cable assembly, preventing attachment of the control cable assembly until the source cable assembly has been properly accessed by the control cable, and providing for the radioactive capsule being safely stored in its stored position within the storage unit before the control cable assembly can be disconnected.

Another object of the present invention is to provide for automatic locking of the radioactive capsule within the storage unit when it is returned to its stored position.

Another object of the present invention is to provide an improved coupling apparatus which provides for automatic locking of the radioactive capsule in its stored position within the storage unit without having to add a fitting to the radioactive capsule which must move with the radioactive capsule at all times.

SUMMARY OF THE INVENTION

To accomplish the foregoing and other objects, features and advantages of the invention, there is provided an improved coupling apparatus which includes disconnectable coupling means having a connector assembly fixed to a storage unit in a radiographic system and a separable control cable assembly of tubular shape. The connector assembly has a tubular aperture for receiving the separable control cable assembly endwise therein, and means for releasably locking the control cable assembly to the connector assembly. The connector assembly includes means responsive to movement of the source cable assembly for automatic locking of the radioactive capsule in the stored position upon return of the radioactive capsule to the stored position within the storage unit.

More particularly, in accordance with the invention, there is provided a sliding means for sliding between an open position, during which the radioactive capsule is free to move, and a locking position during which the radioactive capsule is locked in the stored position. A triggering means is attached to the flexible leader of the source cable assembly which is adapted to trigger movement of the sliding means to its locking position upon returning the radioactive capsule to the stored position, for automatic locking of the radioactive capsule in the stored position within the storage unit.

In a preferred embodiment of the invention, there is provided a dial mounted in the connector assembly for concentric rotation about the axis of the tubular aperture wherein the dial has an engagement means activated upon rotating the dial. The separable control cable assembly has means to receive the engagement means of the connector assembly for locking the separable control cable assembly against withdrawal from the tubular aperture upon rotation of the dial.

BRIEF DESCRIPTION OF THE DRAWINGS

The advantages of the invention, as well as the objects, should now become apparent upon reading the following description taken in conjunction with the accompanying drawings, in which.

DETAILED DESCRIPTION OF THE PREFERRED EMBODIMENT

The present invention relates in general to a coupling apparatus for connecting a separable control cable assembly to a camera storage unit in a radiographic system, having a connector assembly fixed to the camera storage unit and a separable control cable assembly. The device generally operates by connecting the separable control cable assembly to the connector assembly for controlling movement of radioactive material, stored in a camera storage unit, between the stored location and a use location outside of the camera storage unit.

The separable control cable assembly utilizes a control cable to attach to and drive a source cable assembly, which is stored inside a camera storage unit, and includes the radioactive material.

The fixed connector assembly has a tubular aperture for receiving the tubular shaped separable control cable assembly endwise, and means for releasably locking the separable control cable assembly in the tubular aperture. The fixed connector assembly and separable control cable assembly are aligned with the entrance port of a camera storage unit so that the separable control cable assembly will utilize its control cable to guide the source cable assembly through and out of the camera storage unit, when locked in the tubular aperture of the fixed connector assembly. The fixed connector assembly incorporates a locking slide and engaging ridge for locking and releasing the source cable assembly and the separable control cable assembly respectively, as desired. The locking slide in the fixed connector assembly retains the source cable assembly until the locking slide is released by proper connection of the separable control cable assembly. The locking slide and engaging ridge are then operable to release the source cable assembly for movement through the camera storage unit and to lock the separable control cable assembly to the fixed connector assembly respectively.

The coupling apparatus is such that the source cable assembly will not be released by the locking slide until there is a proper connection of the separable control cable assembly to the fixed connector assembly, at which time the engaging ridge will lock the separable control cable assembly to the fixed connector assembly, thereby preventing decoupling of the separable control cable assembly until the source cable assembly is returned to its stored position. When the source cable assembly is returned to its stored position, the locking slide automatically locks the source cable assembly in that position, thereby safely storing the radioactive material in the camera storage unit.

Figure 1:
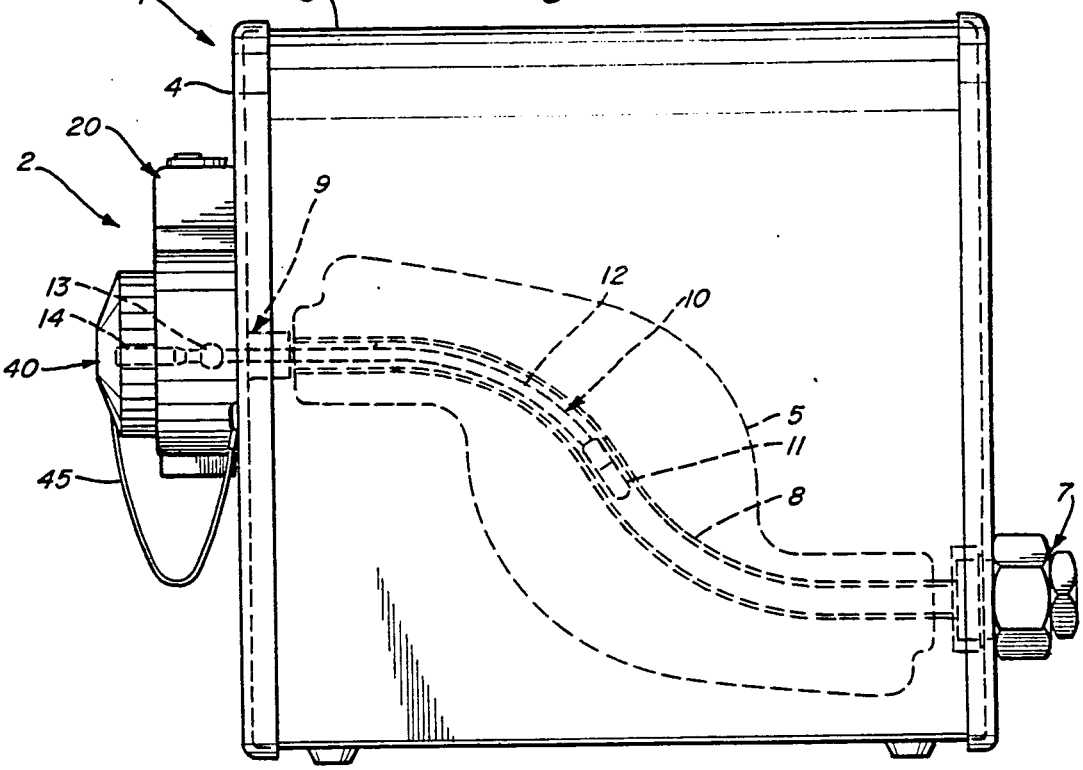
FIG. 1 is a side view of the camera and the connector assembly.
Figure 15:
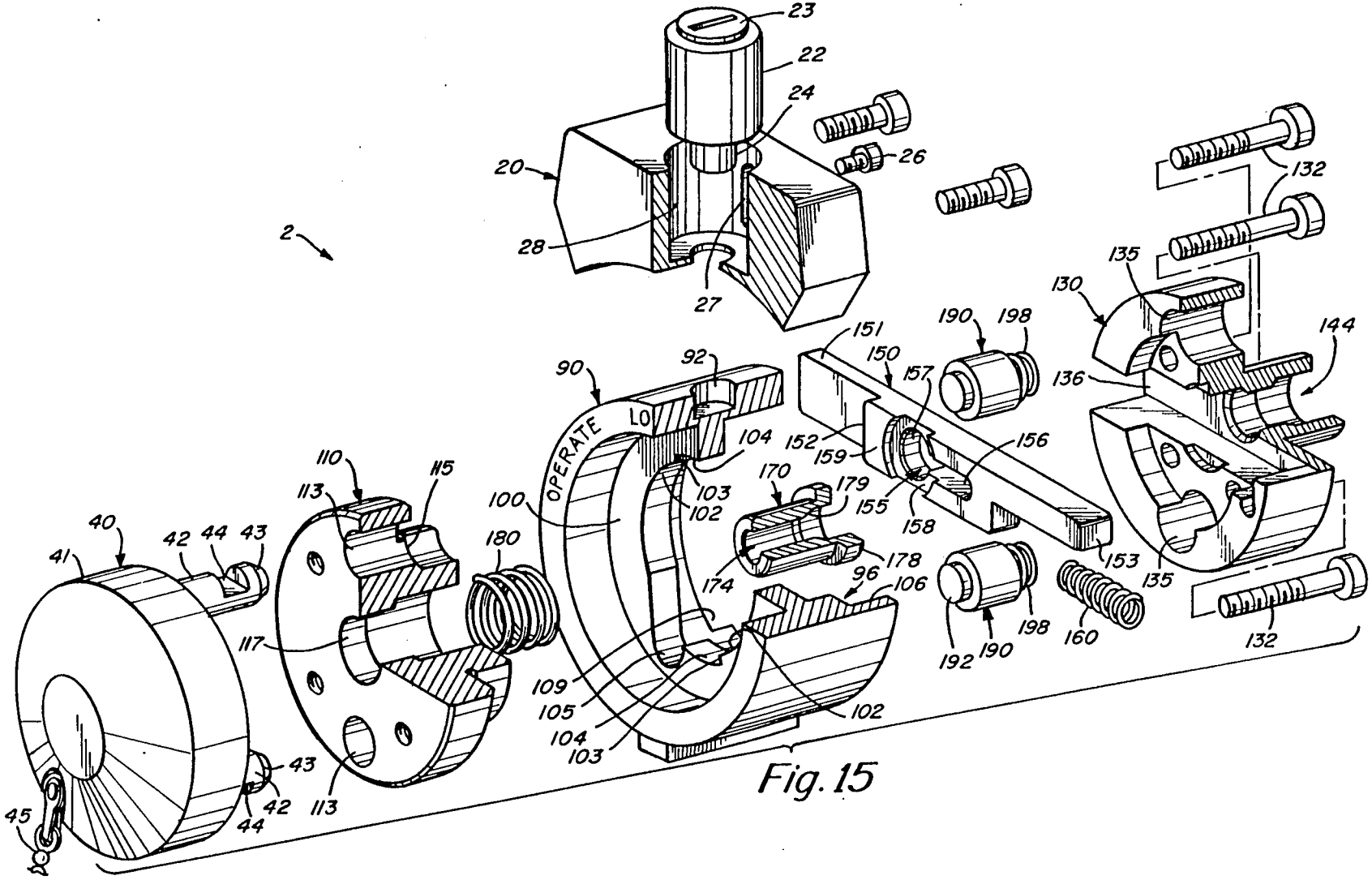
FIG. 15 is an exploded perspective view of the connector assembly.

Reference is now made to the FIGS. in which FIG. 1 illustrates a typical camera storage unit. FIGS. 2, 4, 5, 7, 8, 11 and 12 show front external views and disected internal views of the fixed connector assembly during connection of the separable control cable assembly and operation of the control cable assembly to control movement of the source cable assembly. FIGS. 3, 6, 9, 10, 13 and 14 illustrate cross sectional views of the fixed connector assembly and separable control cable assembly during different stages of the connection process. FIG. 15 illustrates the components of the fixed connector assembly in an exploded perspective view.

Referring now to FIG. 15, the fixed connector assembly 2 is shown and is comprised essentially of a selector body 130 with a slideway 136 formed in it, a locking slide 150, a sleeve 170, a selector ring 90, a selector ring retainer 110 in which the tubular aperture 117 is formed, a lock assembly 20, and a cap 40 which is removed before connection of the separable control cable assembly 60. The separable control cable assembly 60 is comprised essentially of a tubular connector body 62, an internal control cable 64 intended to move through tubular aperture 117, and a slidable attachment collar 70 intended to fit in the space which cap 40 occupied, this component being illustrated in FIGS. 6 and 9. The fixed connector assembly 2 is assembled with bolts 132 and in use is attached to a typical camera storage unit in a radiographic system for safe storing of radioactive material such as the camera storage unit 1 shown in FIG. 1.

A typical camera storage unit such as the camera storage unit 1 shown in FIG. 1, is comprised generally of the camera body 3, a face plate 4 to which the fixed connector assembly 2 is attached, tubing 8 which extends from entrance port 9 to exit port 7, a depleted uranium shield 5 which surrounds tubing 8 and provides safe shielding during storage of the radioactive material, and a source cable assembly 10. The source cable assembly 10 comprises a source connector 14 stored within the fixed connector assembly and to which the control cable 64 of the control cable assembly 60 is attached, a stop ball 13 locked within the fixed connector assembly 2, a radioactive source capsule 11, and a source cable 12 which runs from the source connector 14 to the radioactive source capsule 11 within the tubing 8. The fixed connector assembly 2, through locking of ball 13 in a seated position, thereby prevents movement of the source cable assembly 10 until a proper connection has been made by the separable control cable assembly 60.

Referring back now to FIG. 15 which illustrates the components of the fixed connector assembly 2, the selector body 130 has a passage 144 through it which aligns with entrance port 9 of the camera storage unit 1, when the fixed connector assembly 2 is attached to the camera storage unit 1. The passage 144 extends from the bottom wall of the slideway 136. Within the selector body lie two holes 135 on opposite sides of the slideway 136. The spring driven anti rotation lugs 190 lie within holes 135. Springs 198 urge the reduced diameter heads 192 of the anti-rotation lugs 190 away from the direction of the camera storage unit. Cap 40 is secured to the front of the fixed connector assembly 2 and must be removed before attaching the separable control cable assembly 60, of which control cable 64 moves through tubular aperture 117 and attachment collar 70 occupies clearance holes 113. Cap 40 is locked to the fixed connector assembly 2 in general by two prongs 42 extending from the rear of cap body 41. These can be seen in FIG. 5, which shows a rearview of the cap 40. These can also be seen in FIG. 15 at the far left. The prongs 42 have slots 44 cut into them which are engaged by the selector ring ridge 100 in selector ring 90 as can be seen in FIG. 15. This engagement of the slots 44 of the prongs 42 holds the cap 40 to the fixed connector assembly 2. Cap 40 is also secured to the camera by a sash chain or a retaining chain 45. Lock cylinder 22, of lock assembly 20, when down and locked, prevents rotation of the selector ring 90. Locking lug 24 engages the recess 92 of the selector ring 90 when the lock cylinder 22 is in the down position as shown in FIG. 15. The lock cylinder 22 is in the lock position in FIG. 2. The lock cylinder 22 can be unlocked with a key by inserting the key in the key tumbler 23.

Figure 2:
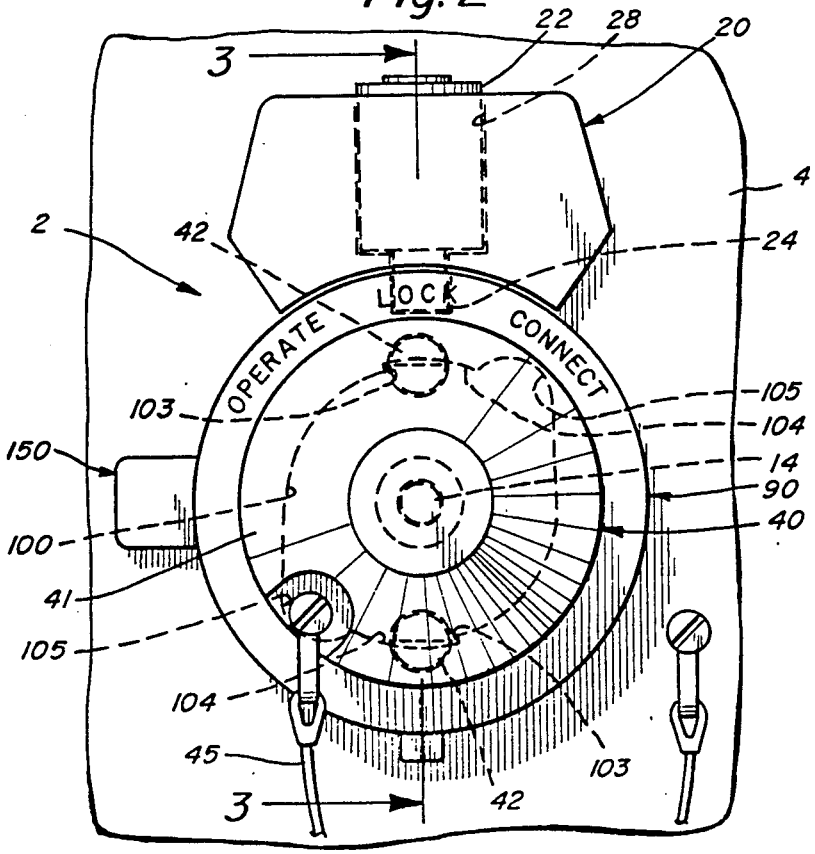
FIG. 2 is a front view of the connector assembly.
Figure 3:
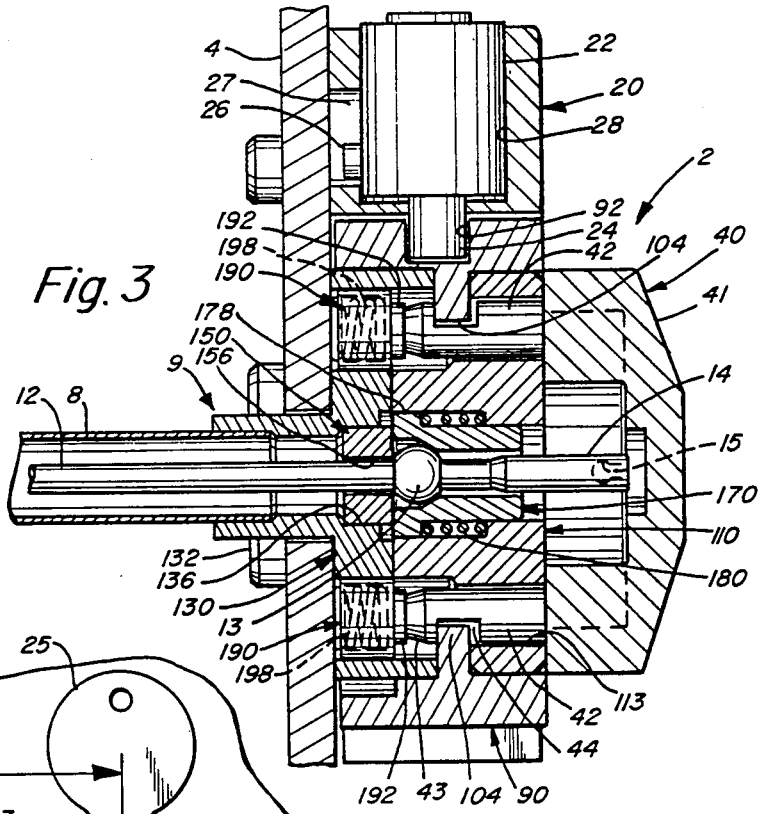
FIG. 3 is a longitudinal cross sectional view of the connector assembly, taken along line 3—3 of FIG. 2.
Figure 4:
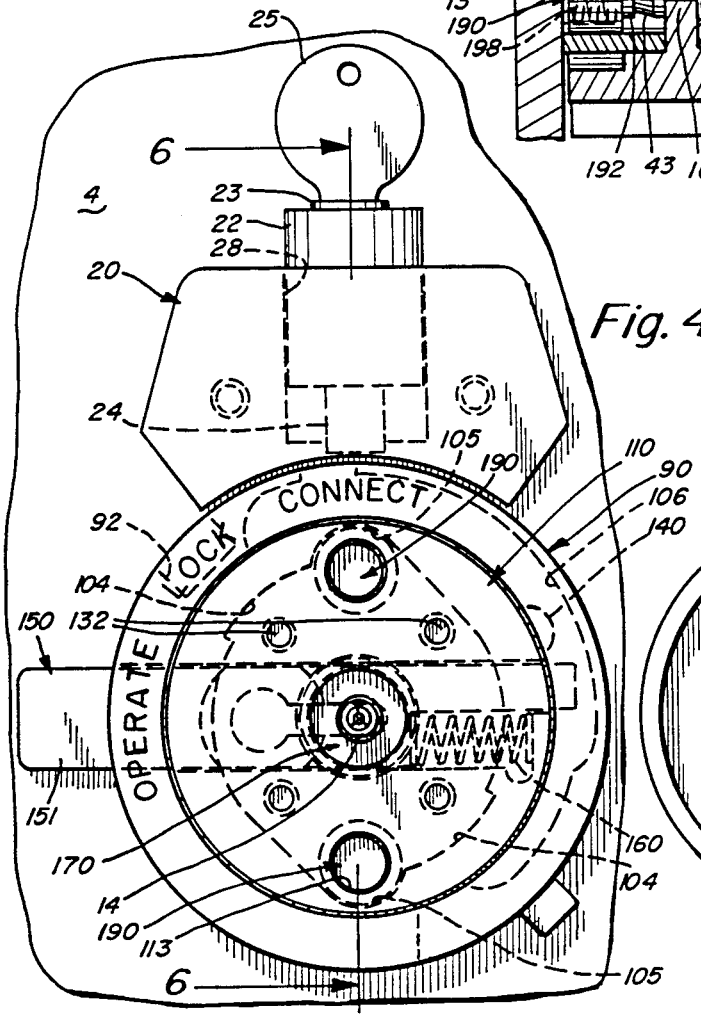
FIG. 4 is a front view of the connector assembly, with the lock disengaged, the connector in the connect position, and the cap removed.
Figure 5:
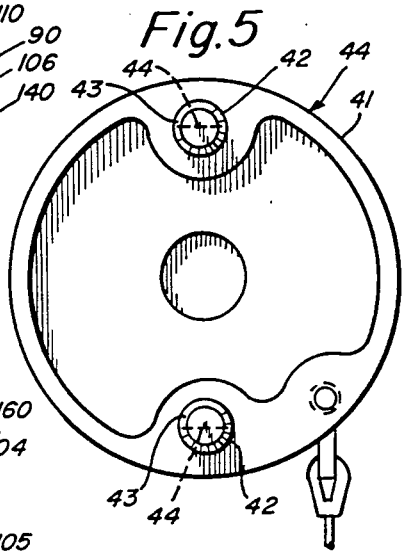
FIG. 5 is a rear view of the cap itself.

Referring to FIG. 2, which shows a front view of the fixed connector assembly, selector ring 90 is shown in the lock position, as it would be during storage of the source cable assembly 10 in the camera storage unit 1. In the lock position, selector ring 90 is such that the next to-smallest areas 104 of selector ring ridge 100 engage the slots 44 of prongs 42. With these ridge areas 104 engaging the slots 44, the prongs 42 and, thus, the cap 40 are prevented from being retracted. FIG. 4 illustrates the ridge areas 104 which aid in the locking action of the cap 40 through a longitudinal cross-sectional view of the fixed connector assembly 2. For subsequent operation, the selector ring 90 is turned to its connect position and the cap 40 is removed from the fixed connector assembly 2 for attachment of the separable control cable assembly 60.

Prongs 42 of cap 40 sit in clearance holes 113 of selector ring retainer 110 while slots 44 are engaged by selector ring ridge 100. The beveled ends 43 of the prongs 42 rest against the reduced diameter heads 192 of anti rotation lugs 190. The anti-rotation lugs 190 urge the prongs 42 and hence the cap 40 in a direction away from the camera storage unit 1, but the cap 40 is retained from being removed by the engagement of selector ring ridge 100 with slots 44 of the prongs 42. With subsequent movement of the selector ring 90 to the connect position, the engagement of selector ring ridge 100 in slots 44 is released and the anti-rotation lugs 190 urge the prongs 42 out of the clearance holes 113 for removal of cap 40.

While in its stored position, source cable assembly 10 is prevented from being removed from the camera storage unit. Ball 13 of source cable assembly 10 rests in seat 179 of flange 170, is too wide to fit through passage 174 within flange 170, and is prevented from movement in the direction towards the camera storage unit by narrow slot 156 in locking slide 150, which is lined up with passage 174 during the lock position of selector ring 90. Locking slide 150 is held in such position as narrow end 153 of locking slide 150 engages the side 106 of recess 96 in the selector ring 90. It is not until locking slide 150 can be urged against the spring 160 when clearance hole 157 of locking slide 150 lines up with passage 174 of sleeve 170 and the ball 13 is free to move towards the camera storage unit 1. This movement of locking slide 150 cannot occur until a proper connection of the separable control cable assembly 60 has been made and the selector ring 90 has been rotated to the operate position.

Referring to FIG. 4, a key 25 may be inserted into the key tumbler 23 and rotated to free lock cylinder 22. This allows lock cylinder 22 to rise up in bore 28. Cylinder 22 is guided through bore 28 by screw 26 which rides in slot 27. This action pulls the locking lug 24 up the recess 92 in the selector ring 90. This frees up the selector ring 90 for rotation.

Referring to FIG. 2, it can be seen that the selector ring 90 can only be rotated counterclockwise from the lock position to the connect position, a clockwise rotation is prevented by the contact between shoulders 103 and the slots 44 of the prongs 42. Rotating the selector ring 90 clockwise from the lock position would result in the shoulders 103 of selector ring ridge 100 contacting the edges of slots 44 in the prongs 42. Thus, the selector ring 90 can only be rotated to the connect position from the lock position. This is done to allow for removal of the cap 40 and subsequent attachment of the separable control cable assembly 60.

FIG. 4 shows the selector ring in the connect position. Upon rotation of the selector ring 90 to the connect position, clearance holes 105 in selector ring ridge 100 are aligned with prongs 42, thereby releasing the engagement of selector ring ridge 100 with slots 44 of prongs 42. With the clearance holes 105 aligned with the prongs 42, the prongs 42 are freed for movement. The spring loaded anti rotation lugs 190 then, being urged by springs 198, push the prongs 42 partially out of the clearance holes 113 in the selector ring retainer 110. The anti-rotation lugs 190 are stopped from this movement by the shoulders 115 in the selector ring retainer 110 which can be seen in FIG. 15. With the prongs 42 partially pushed out of the clearance holes 113, cap 40 can then be fully removed manually and left dangling by retainer chain 45. The source connector 14 which is attached to the ball 13 and source cable 12, is then exposed for connection to the separable control cable assembly 60.

Figure 6:
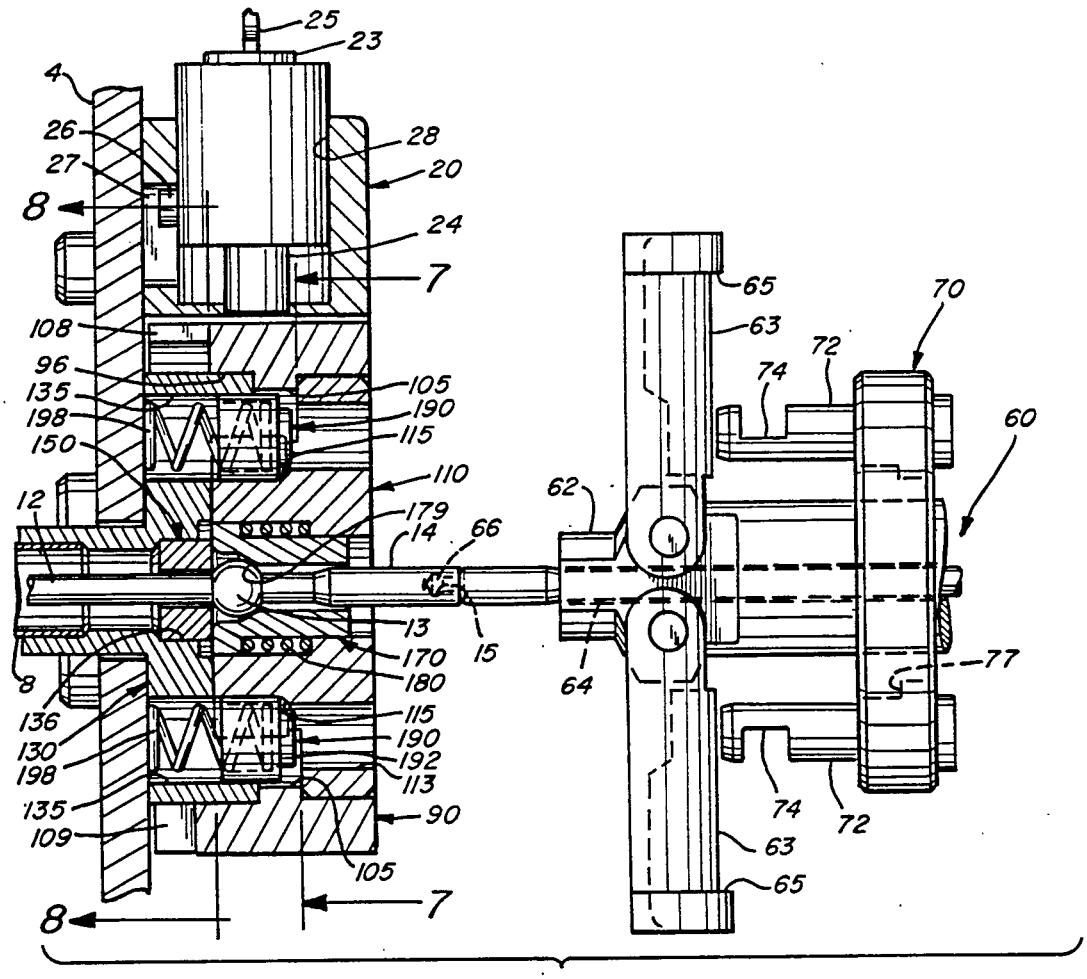
FIG. 6 is a cross sectional view of the connector assembly taken along line 6—6 of FIG. 4 which shows the separable control cable assembly partially attached.
Figure 7:
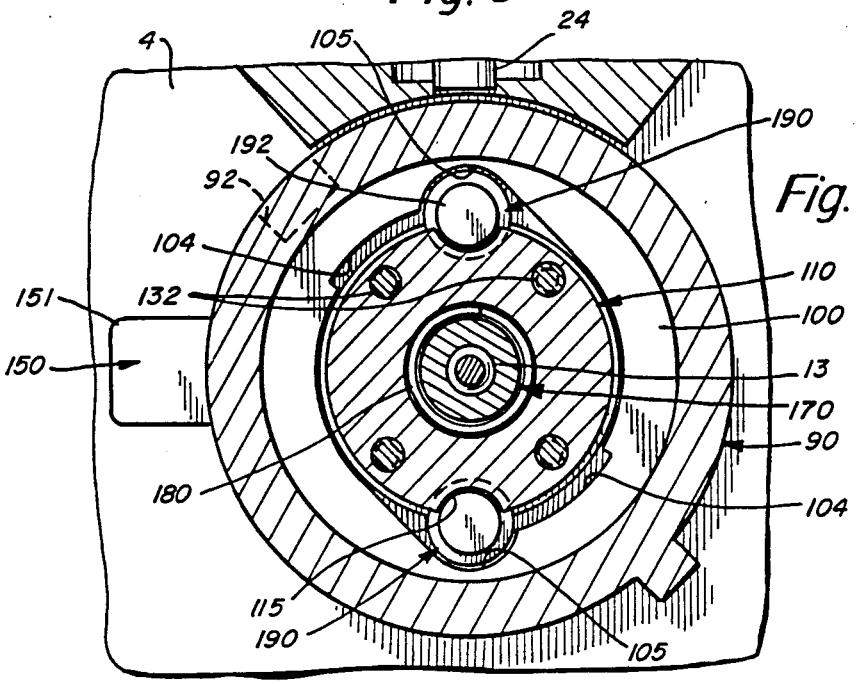
FIG. 7 is an axial cross-sectional view taken along line 7—7 of FIG. 6.

Referring now to FIG. 6, the separable control cable assembly 60 is shown in the right hand side of the diagram partially attached to the camera storage unit 1. As can be seen in the center of FIG. 6, the ball 66 of control cable 64 is inserted in the spherical recess 15 of the source connector 14. FIG. 6 shows an intermediate step of attachment of the separable control cable assembly 60 to the camera storage unit 1. As can be seen in FIG. 6, the control cable attachment collar 70 has prongs 72 similar to the prongs 42 on cap 40. The prongs 72 similarly are inserted in clearance holes 113 and slots 74 are similarly engaged by the selector ring ridge 100 of the selector ring 90. The difference between the prongs 72 on the connection collar 70 and the prongs 42 on the cap 40, is that the slots 74 on the prongs 72 are cut deeper than the slots 44 on the prongs 42. The slots 74 are cut deeper to match with the smallest diameter areas 102 of the selector ring ridge 100 in the selector ring 90. Referring to FIG. 6, which shows the separable control cable assembly partially attached to the fixed connector assembly, the control cable attachment connection collar 70 has been slid back on the connector body 62. This allows the clam shell jaws 63 to be opened. With the clam shell jaws 63 opened, the control cable 64 and ball 66 are exposed for attachment. As shown, the clam shell jaws 63 have been opened and the ball 66 inserted into recess 15 of source connector 14.

During the connection process, the source cable assembly 10 is held in its stored position within the camera storage unit as ball 13 is prevented from movement out of sleeve 170 due to the narrow slot 156 of locking slide 150 being lined up with the passage 174 of sleeve 170, as described above.

Figure 10:
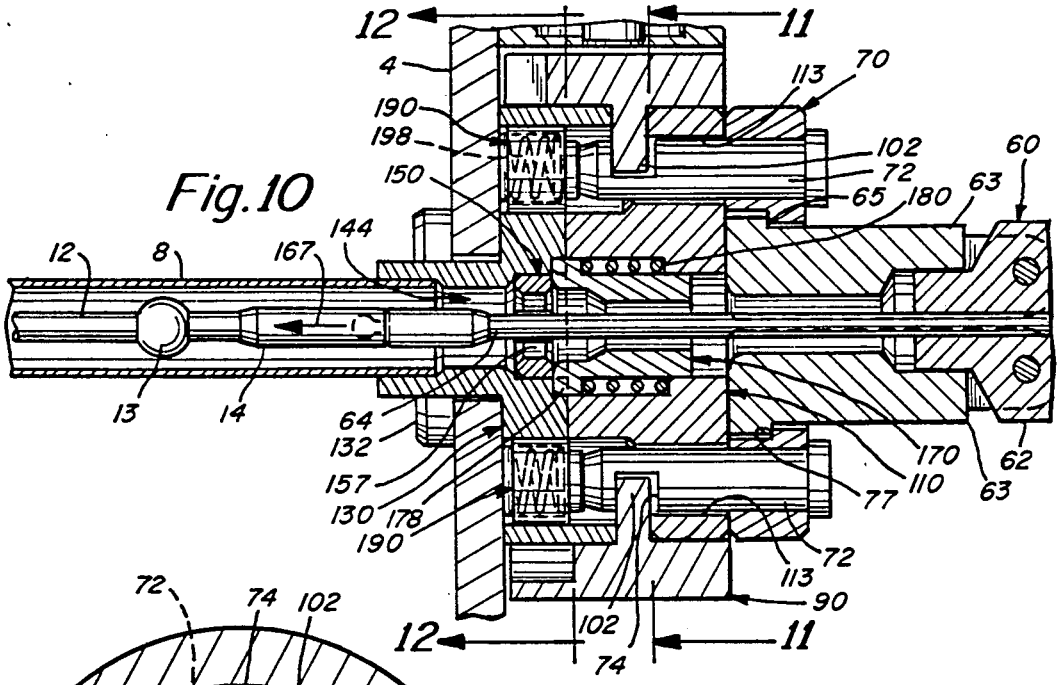
FIG. 10 is a longitudinal cross sectional view similar to FIG. 6 but with the separable control cable assembly fully attached to the connector and the control cable advancing the radioactive source forward.
Figure 11:
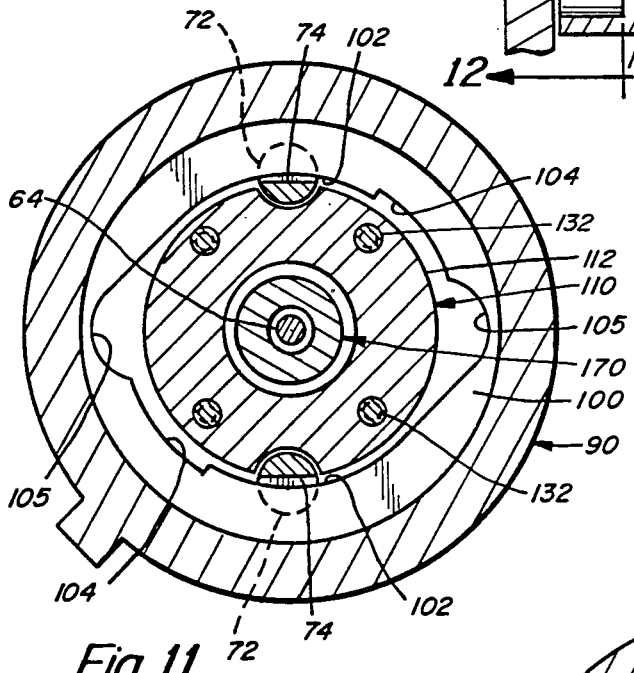
FIG. 11 is a schematic axial cross-sectional view taken along line 11—11 of FIG. 10.

While in the connect position, the selector ring 90 is prevented from being rotated by contact with the spring loaded anti-rotation lugs 190. After attachment of ball 66, clam shell jaws 63 are closed. This allows connector collar 70 to be pushed forward on connector body 62. When connector collar 70 is pushed forward, prongs 72 are inserted in clearance holes 113 of selector ring retainer 110 The insertion of prongs 72 into clearance holes 113 causes the compression of the springs 198 in the anti-rotation lugs 190 when the ends of prongs 72 contact the reduced diameter head ends 192 of anti-rotation lugs 190. The connection collar 70 is pushed forward until seated. With the anti rotation lugs 190 compressed, the selector ring 90 is free for rotation. FIG. 10 shows the completed connection. Upon completing the connection, the selector ring 90 is rotated clockwise to the operate position, prior to movement of the source cable 10 which is still prevented from movement due to the locking slide 150 holding the ball 13 in sleeve 170.

Because the locking slide 150 is held in position by the selector ring 90 and the selector ring 90 is prevented from being rotated during the connection process, the source cable assembly 10 is safely stored within the camera storage unit 1 until a proper connection of the separable control cable assembly 60 has been made.

Figure 12:
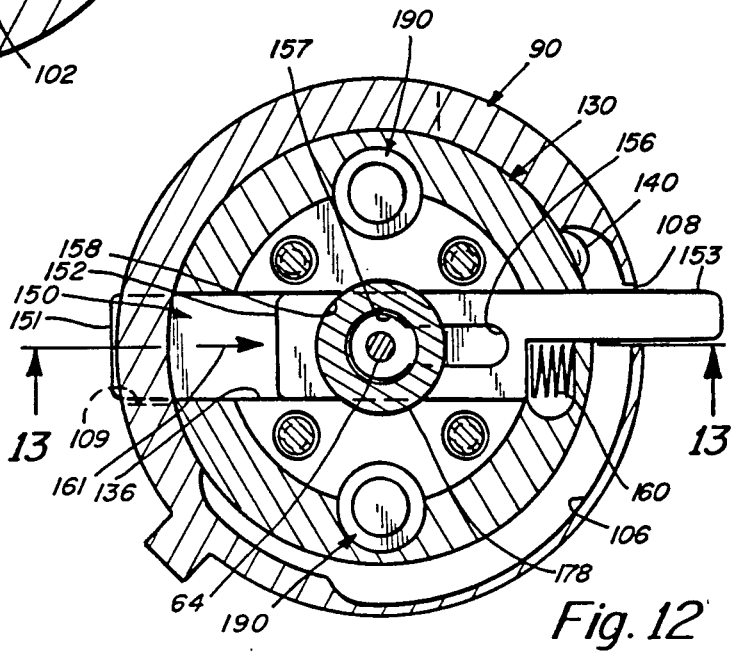
FIG. 12 is a schematic axial cross sectional view taken along line 12—12 of FIG. 10.
Figure 13:
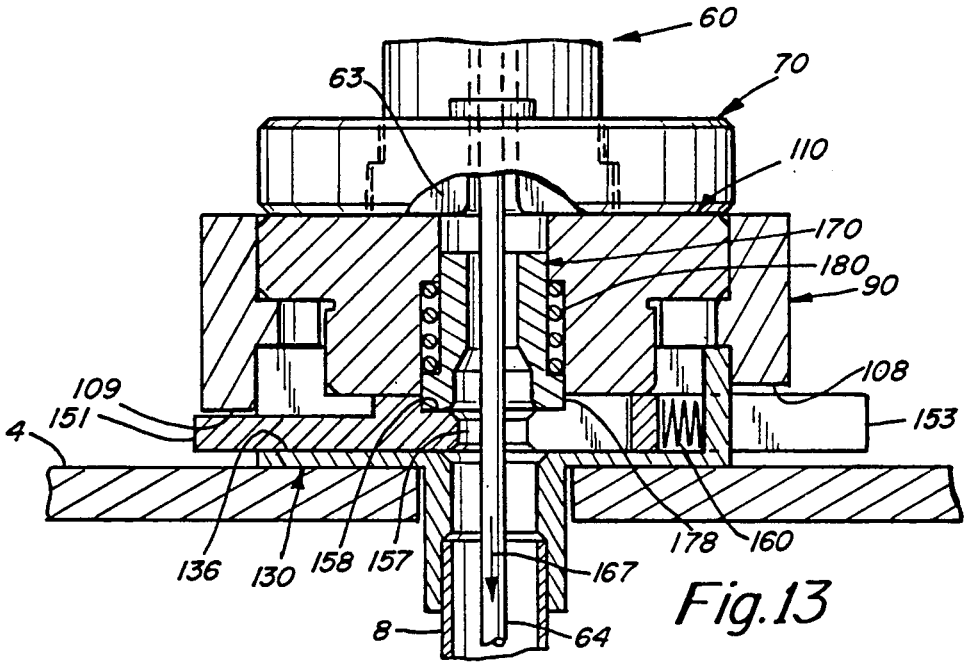
FIG. 13 is a schematic cross-sectional view taken along line 13—13 of FIG. 12.
Figure 14:
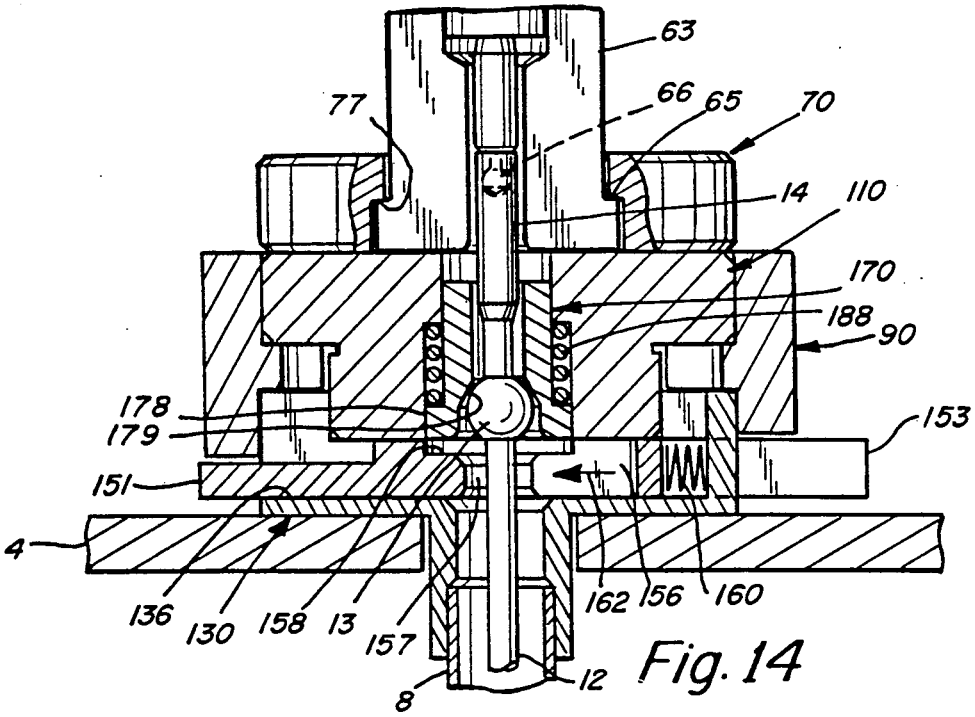
FIG. 14 is a schematic cross-sectional view similar to FIG. 13 but with the control cable retracted and the stop ball releasing the locking slide.

Rotating the selector ring 90 to the operate position places the small diameter areas 102 of selector ring ridge 100 into the slots 74 of prongs 72. By this engagement, removal of the connector collar 70 and thus the control cable assembly 60 is prevented. This can be seen in FIG. 11. With the connector collar 70 being locked to the fixed connector assembly 2, the control cable assembly 60 is locked to the fixed connector assembly 2 as well due to the shoulders 77 of connector collar 70 engaging the shoulders 65 on clam shell jaws 63 of connector body 62. The selector ring 90, in the operate position, is positioned by the stop rivet 140 of selector body 130 contacting the end of clearance slot 109 in selector ring recess 96. With selector ring 90 in the operate position, clearance hole 108 of selector ring recess 96 is aligned with the narrow end 153 of locking slide 150. This can be seen in FIG. 12. This allows the locking slide 150 to be pushed towards the narrow end 153 against spring 160 as indicated by arrow 161 in FIG. 12. Referring to FIG. 12, as the locking slide 150 is pushed toward the narrow end 153, the recess seat 158, in face 159 of the locking slide 150, comes into alignment with sleeve 170. The spring 180, pushing against flange 178 of sleeve 170, snaps flange 178 into recess seat 158. This holds the locking slide 150 in a position so that clearance hole 157 of key hole slot 155 of locking slide 150 is in alignment with passage 174 of sleeve 170 and passage 144 of selector body 130. With the clearance hole 157 aligned with passage 174 of sleeve 170, the ball 13 of the source cable assembly 10 is freed for movement through clearance hole 157 towards the camera storage unit 1. The source cable assembly 10 is advanced by movement of the control cable 64 which is attached to the source cable assembly via the source connector 14. The advancement of the control cable 64 is indicated by arrow 167 in FIGS. 10 and 13. The control cable 64 advances the source assembly cable 10 with the radioactive source capsule 11 to a desired location for operation of the radioactive capsule 11. Upon completion of the function performed by the radioactive capsule 11, the control cable 64 is rewound by conventional means in order to once again safely store the source cable assembly 10 within the camera storage unit 1.

The control cable 64 is rewound until ball 13 of source cable assembly 10 enters through passage 144 of selector body 130, continues through clearance hole 157 of key hole slot 155 in locking slide 150 and is seated in sleeve 170 in the seat 179. This can be seen in FIG. 14 with the ball 13 seated against seat 179. By continuing to rewind the control cable 64, ball 13 is pushed against seat 179 and sleeve 170 is pulled outward against the spring pressure from spring 180. With this force, the flange 178 of sleeve 170 is pulled out of seat 158 in locking slide 150, which releases the locking slide 150. Once released, the locking slide 150 is automatically urged toward the actuation end 151 by spring 160. This motion of the locking slide 150 is indicated by arrow 162 in FIG. 14. With the motion toward the actuation end 151 of locking slide 150, the narrow slot 156 of key hole slot 155 of locking slide 150 closes around the source cable 12 just behind the ball 13. This action captures the ball 13 in sleeve 170, thus, automatically locking the source cable assembly 10 within the camera storage unit, upon its return to its safely stored position.

Figure 8:
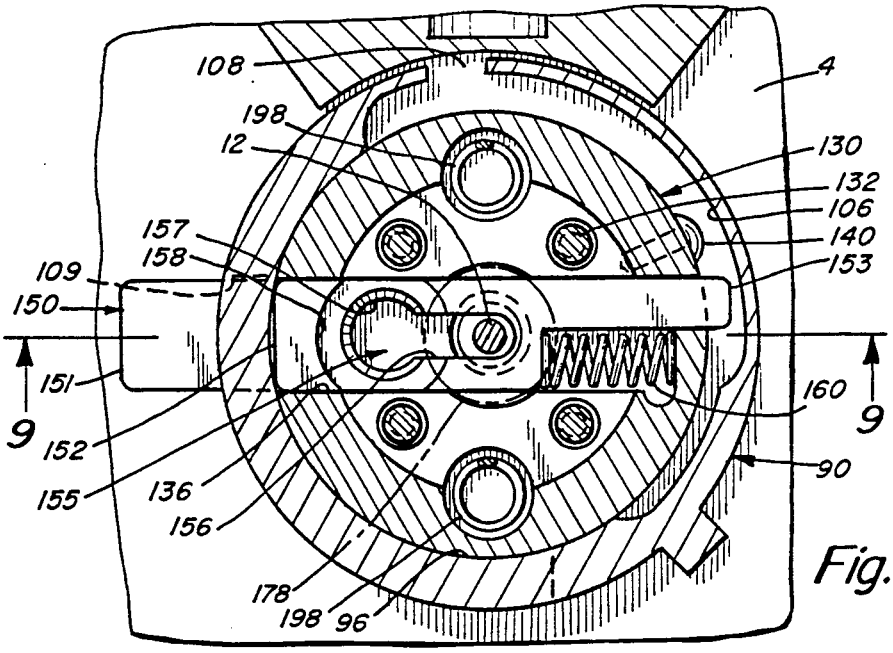
FIG. 8 is an axial cross sectional view taken along line 8—8 of FIG. 6.
Figure 9:
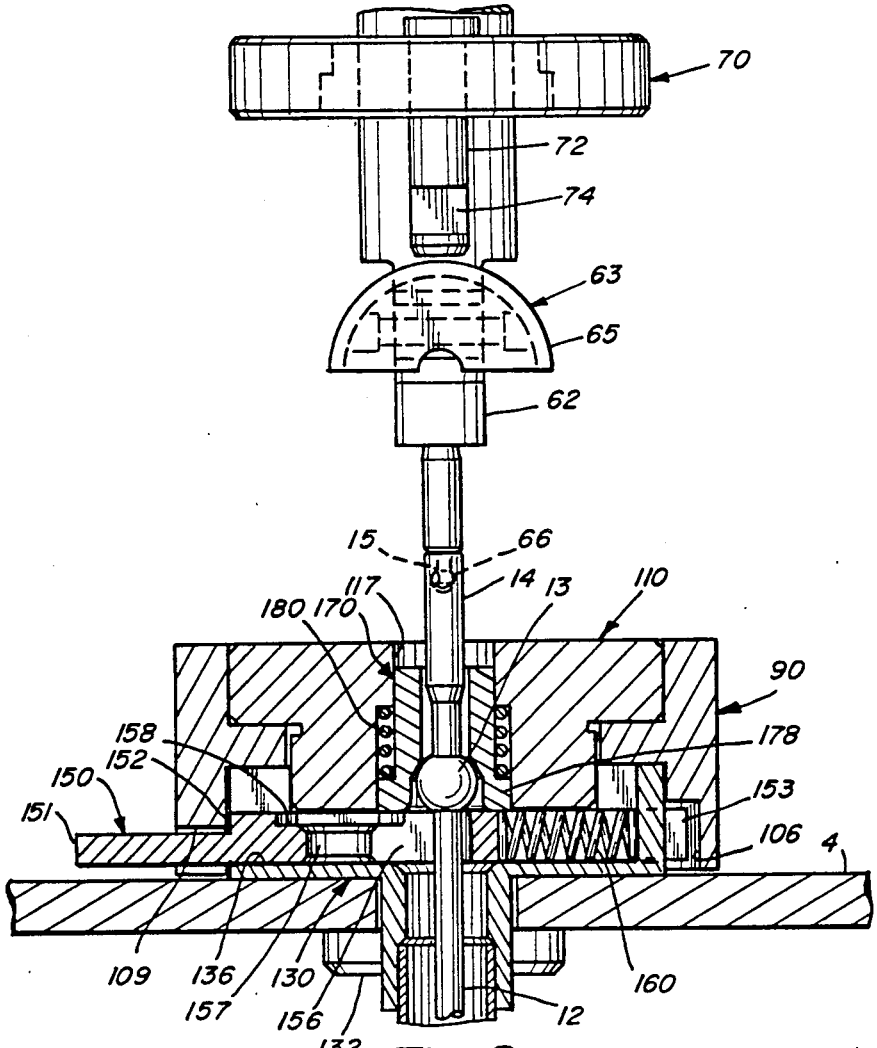
FIG. 9 is a plan cross sectional view taken along line 9—9 of FIG. 8 showing the separable control cable assembly partially attached to the connector.

Referring to FIGS. 8 and 9, the motion of locking slide 150 toward the actuation end 151 can be seen. The locking slide 150 travels toward the actuation end 151 until ridge 152 of locking slide 150 contacts the recess 96 of the selector ring 90. With the ball 13 captured in sleeve 170, the selector ring 90 is ready to be rotated counterclockwise to the connect position for subsequent removal of the separable control cable assembly 60.

Once the selector ring 90 is rotated counterclockwise to the connect position, the clearance holes 105 are aligned with prongs 72 of the connection collar 70. With this alignment, the spring loaded anti-rotation lugs 190 partially push the prongs 72 out of clearance holes 113. The connection collar 70 is then slid back on the connector body 62 until clearance is made for the clam shell jaws 63 to open. With the clam shell jaws 63 open, removal of the ball 66 from the source connector 14 can be accomplished. Because the selector ring 90 cannot be rotated to the connect position until ball 13 is captured in sleeve 170, the control cable assembly 60 is prevented from being removed until the source cable assembly 10 is safely stored within the camera storage unit 1. This action also prevents the radioactive source capsule 11 from being locked outside of the camera unit 1.

After removal of the ball 66 from the source connector 14, the separable control cable assembly can be completely removed, and the cap 40 can be pushed back in place. With the cap 40 pushed back in place, the selector ring 90 can be rotated back to the lock position, at which time the locking lug 24 of the lock assembly 20 and recess 92 of selector ring 90 are lined up for engagement. At this time, the lock cylinder can be urged down to lock the selector ring 90 from movement. In addition, the areas 104 of selector ring ridge 100 engage the slots 44 of the prongs 42 which lock in the cap 40.

The following safety features exist with the coupling apparatus of the present invention:

1. The source cable assembly 10 remains in the camera storage unit until a proper connection has been made by the control cable assembly, the selector ring has been rotated to the operate position, and the locking slide 150 has been depressed;

2. The control cable assembly is prevented from being attached to the camera storage unit until the source cable assembly 10 has been properly accessed by the control cable 64;

3. The source cable assembly including the radioactive source capsule 11 cannot be accidentally locked out of the camera storage unit 1;

4. The source cable assembly 10 is automatically locked in the camera storage unit 1 when it is returned to its fully stored position;

5. The source cable assembly 10 must be safely stored and locked in the camera storage unit before the selector ring 90 can be turned to the connect position and the control cable assembly 60 disconnected from the fixed connector assembly and camera storage unit 1.

Having now described a limited number of embodiments of the present invention numerous other embodiments and modifications thereof are contemplated as falling within the scope of the present invention as defined by the appended claims.

What is claimed is:

1. A coupling apparatus for providing cable controls to a storage unit in a radiographic system for manipulating a quantity of radioactive material, in a radioactive capsule, between a stored position and a use position, the storage unit having a passage through it for storing said radioactive capsule in the passage and shielding the surrounding environment from the stored radioactive material, a flexible leader attached to said radioactive capsule adapted to be guided through said passage, and comprising:

disconnectable coupling means having a connector assembly fixed to said storage unit at one end of said passage and a separable control cable assembly of tubular shape, said connector assembly having a tubular aperture for receiving said separable control cable assembly endwise therein, and means for releasably locking said control cable assembly to said connector assembly, said connector assembly having means responsive to movement of said flexible leader for automatic locking of said radioactive capsule in the stored position upon return of said radioactive capsule to the stored position within said storage unit, said responsive means comprising:

a slide member and a sleeve, said sleeve having a hole defined therein, said slide member having a larger diameter aperture and a smaller diameter aperture defined therein, a mass attached to said source cable means for engagement with said sleeve hole and said small diameter aperture, said slide member having an open position during which said sleeve hole and said larger diameter aperture are in alignment, and a locked position during which said sleeve hole and said smaller diameter aperture are in alignment capturing said mass therebetween, biasing means for urging said slide member toward said locked position, and said slide member and said sleeve defining therebetween interlocking means for holding said slide member in said open position, said mass triggering the interlocking means to disengage upon return of said radioactive capsule to the stored position allowing said biasing means to move said slide member.

2. A coupling apparatus according to claim 1 wherein said means for releasably locking includes a dial mounted in said connector assembly for concentric rotation about the axis of said tubular aperture, said dial having engagement means activated upon rotating said dial, said separable control cable assembly having means to receive said engagement means for locking said separable control cable assembly against withdrawal from said tubular aperture upon rotation of said dial;

3. A coupling apparatus according to claim 2 wherein said mass and said radioactive capsule are attached to said flexible leader at substantially opposite ends thereof, said mass extending into said connector assembly when said radioactive capsule is stored in said storage unit.

4. A coupling apparatus according to claim 3 wherein said dial has a connect position during which said engagement means are inoperative and an operate position during which said engagement means are activated to engage said means for receiving said engagement means, thereby locking said separable control cable assembly against withdrawal.

5. A coupling apparatus according to claim 4 wherein said dial further includes means providing a dial surface, said dial surface having an aperture formed therein, said dial surface for engaging one end of said slide member when said slide member is in the locked position and said dial in said connect position, thereby preventing movement of said slide member from said locked position to said open position, said aperture to receive said one end of said slide member when said dial is in said operate position and said slide member in said open position.

6. A coupling apparatus according to claim 5 wherein said biasing means includes a spring.

7. A coupling apparatus according to claim 6 wherein said interlocking means comprises a recess defined in said slide member for receiving said sleeve.

8. A coupling apparatus according to claim 7 further including means for preventing detachment of said separable control cable assembly from said connector assembly until said radioactive capsule is stored in said stored position, said means for preventing, including said one end of said slide member engaging sides of said aperture of said dial surface while said slide member is in said open position and said dial in said operate position, thereby preventing movement of said dial from said operate position until said slide member is slid from said operate position to said locked position.

9. A method for providing cable controls to a storage unit on a radiographic system for manipulating a quantity of radioactive material, in a radioactive capsule, between a stored position and a use position, the storage unit having a passage through it for storing said radioactive capsule in the passage and shielding the surrounding environment from the stored radioactive material, a flexible leader attached to said radioactive capsule adapted to be guided through said passage, and comprising the steps of:

providing a connector assembly fixed to said storage unit at one end of said passage and a separable control cable assembly of tubular shape, attaching said control cable assembly to said storage unit, said connector assembly having a tubular aperture for receiving said separable control cable assembly endwise therein, and means for releasably locking said control cable assembly to said connector assembly, automatically locking said radioactive capsule in said stored position upon return of said radioactive capsule to the stored position within said storage unit, providing a slide member and a sleeve, said sleeve having a hole defined therein, said slide member having a larger diameter aperture and a smaller diameter aperture defined therein, providing a mass attached to said source cable means for engagement with said sleeve hole and said small diameter aperture, said slide member having an open position during which said sleeve hole and said larger diameter aperture are in alignment, and a locked position during which said sleeve hole and said smaller diameter aperture are in alignment capturing said mass therebetween, and providing biasing means for urging said slide member toward said locked position, and said slide member and said sleeve defining therebetween interlocking means for holding said slide member in said open position, said mass triggering the interlocking means to disengage upon return of said radioactive capsule to the stored position allowing said biasing means to move said slide member.

10. A method according to claim 9 wherein said means for releasably locking includes a dial mounted in said connector assembly for concentric rotation about the axis of said tubular aperture, said dial having engagement means activated upon rotating said dial, said separable control cable assembly having means to receive said engagement means for locking said separable control cable assembly against withdrawal from said tubular aperture upon rotation of said dial.

11. A method according to claim 8 wherein said mass and said radioactive capsule are attached to said flexible leader at substantially opposite ends thereof, said mass extending into said connector assembly when said radioactive capsule is stored in said storage unit.

12. In a radiographic apparatus for manipulating a quantity of radioactive material between a stored position and a use position, including a capsule of said radioactive material, a storage unit with means defining a passage through it for storing the capsule in the passage and shielding the surrounding environment from the stored radioactive material, a source cable means attached to said radioactive capsule and adapted to be guided through said passage, said storage unit passage having respective inlet and outlet ports, a separable control cable means, connector means for receiving the control cable means and disposed at the inlet port of the storage unit, said separable control cable means adapted for releasable engagement with said source cable means, said source cable assembly in combination with the connector means comprising:

a slide member and a sleeve, said sleeve having a hole defined therein, said slide member having a larger diameter aperture and a smaller diameter aperture defined therein, a mass attached to said source cable means, said mass having a diameter too large to fit through said sleeve hole and said smaller diameter aperture and small enough to fit through said larger diameter aperture, said slide member having an open position during which said sleeve hole and said larger diameter aperture are in alignment allowing movement of said source cable means with attached mass in one direction through said larger diameter aperture, and a locked position during which said sleeve hole and said smaller diameter aperture are in alignment capturing said mass therebetween thereby preventing any movement of said source cable means, biasing means for urging said slide member toward said locked position, said slide member and said sleeve defining therebetween interlocking means for holding said slide member in said open position, said mass triggering the interlocking means to disengage upon return of said radioactive capsule to the stored position allowing said biasing means to urge said slide member from said open position to said locked position thereby safely storing said radioactive capsule in said stored position.

13. In a radiographic apparatus as set forth in claim 12 wherein said interlocking means comprises a recess defined in said slide member for receiving said sleeve.

14. In a radiographic apparatus as set forth in claim 13 wherein said mass comprises a ball on said source cable means, said ball being disposed at an end of said source cable remote from said radioactive capsule.

15. In a radiographic apparatus as set forth in claim 14 wherein said biasing means for urging comprises a spring.

16. In a radiographic apparatus for manipulating a quantity of radioactive material between a stored position and a use position, including a capsule of said radioactive material, a storage unit with means defining a passage through it for storing the capsule in the passage and shielding the surrounding environment from the stored radioactive material, a source cable means attached to said radioactive capsule and adapted to be guided through said passage, said storage unit passage having respective inlet and outlet ports, a separable control cable means, connector means for receiving the control cable means and disposed at the inlet port of the storage unit, said separable control cable means adapted for releasable engagement with said source cable means, said source cable assembly in combination with the connector means comprising:

a slide member and a sleeve, said sleeve having a hole defined therein, said slide member having a larger diameter aperture and a smaller diameter aperture defined therein, a mass attached to said source cable means for engagement with said sleeve hole and said smaller diameter aperture, said slide member having an open position during which said sleeve hole and said larger diameter aperture are in alignment, and a locked position during which said sleeve hole and said smaller diameter aperture are in alignment capturing said mass therebetween.

biasing means for urging said slide member toward said locked position, said slide member and said sleeve defining therebetween interlocking means for holding said slide member in said open position, said mass triggering the interlocking means to disengage upon return of said radioactive capsule to the stored position allowing said biasing means to move said slide member.

17. In a radioactive apparatus as set forth in claim 16 wherein said interlocking means comprises a recess defined in said slide member for receiving said sleeve.

18. In a radioactive apparatus as set forth in claim 17 wherein said mass comprises a ball on said source cable means, said ball being disposed at an end of said source cable remote from said radioactive capsule.

19. In a radiographic apparatus as set forth in claim 18 wherein said biasing means for urging comprises a spring.

* * * * *